US011096461B2

(12) United States Patent
Hicks, Jr.

(10) Patent No.: US 11,096,461 B2
(45) Date of Patent: Aug. 24, 2021

(54) AUDIO AND POWER ADAPTER RETENTION DEVICE

(71) Applicant: Dannylee Hicks, Jr., Grayslake, IL (US)

(72) Inventor: Dannylee Hicks, Jr., Grayslake, IL (US)

(73) Assignee: Dannylee Hicks, Jr., Grayslake, IL (US)

( * ) Notice: Subject to any disclaimer, the term of this patent is extended or adjusted under 35 U.S.C. 154(b) by 70 days.

(21) Appl. No.: 16/414,439

(22) Filed: May 16, 2019

(65) Prior Publication Data

US 2019/0350326 A1 Nov. 21, 2019

Related U.S. Application Data

(60) Provisional application No. 62/672,639, filed on May 17, 2018.

(51) Int. Cl.

| | |
|---|---|
| ***A45C 13/02*** | (2006.01) |
| ***A45C 11/00*** | (2006.01) |
| ***A45F 5/00*** | (2006.01) |

(52) U.S. Cl.

CPC ..... *A45C 11/00* (2013.01); *A45C 13/02* (2013.01); *A45F 5/00* (2013.01); *A45C 2011/002* (2013.01); *A45C 2013/025* (2013.01); *A45C 2013/026* (2013.01); *A45F 2005/006* (2013.01)

(58) Field of Classification Search

CPC ... A45C 2011/002; A45C 11/00; A45C 13/02; A45C 2013/025; A45C 2013/026; A45C 2011/001; A45F 5/00; A45F 2005/006; H04R 1/1033

USPC ..... 206/320

See application file for complete search history.

(56) References Cited

U.S. PATENT DOCUMENTS

| | | | | |
|---|---|---|---|---|
| 8,387,790 | B2 * | 3/2013 | Conner | A45C 13/02 206/320 |
| 2010/0294675 | A1 * | 11/2010 | Mangano | A45C 11/04 206/5 |
| 2013/0102368 | A1 * | 4/2013 | Lee | H04M 1/0279 455/575.8 |
| 2013/0148839 | A1 * | 6/2013 | Stevinson | H04R 1/1033 381/384 |
| 2013/0188122 | A1 * | 7/2013 | Daole | G02C 3/04 351/158 |
| 2016/0066453 | A1 * | 3/2016 | Quehl | G06F 1/166 206/45.2 |

OTHER PUBLICATIONS

Indiegogo; OxBack; iPhone 7 Lightning to Headphone Jack Adapter Holder; https://www.indiegogo.com/projects/oxback#/; 5 pages.

* cited by examiner

*Primary Examiner* — Steven A. Reynolds
(74) *Attorney, Agent, or Firm* — Foley & Lardner LLP

(57) ABSTRACT

A retention device for portable audio, video, and power adapters commonly used with portable electronic devices (e.g., mobile phones) includes a shell that is configured to receive a removable insert formed from a resiliently deformable material, which retains and protects an adapter for a portable electronic device. The removable insert may be interchangeable with a plurality of inserts, each of which comprises a cutout region configured to accommodate and retain a corresponding adapter.

11 Claims, 3 Drawing Sheets

FIG. 1
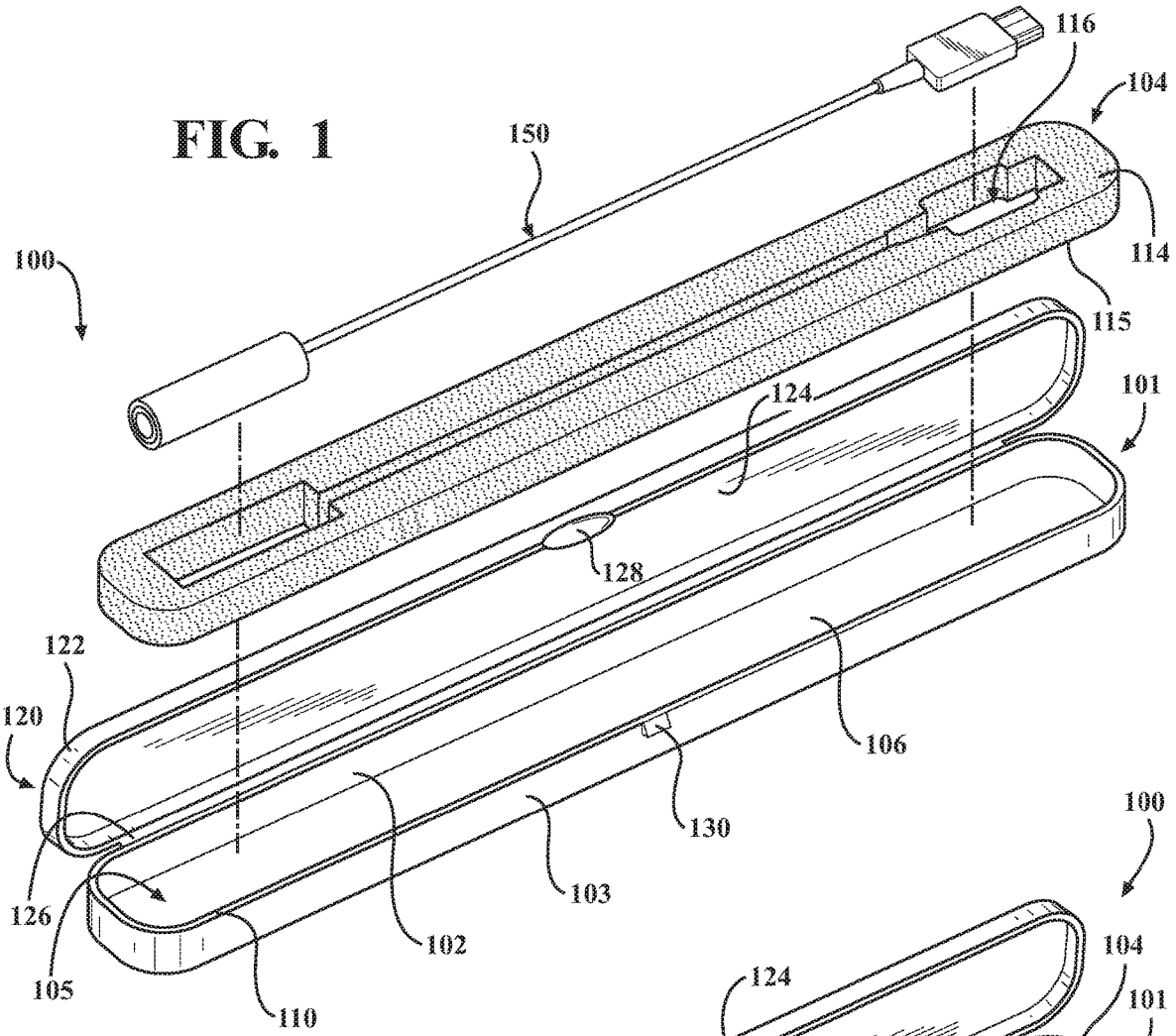
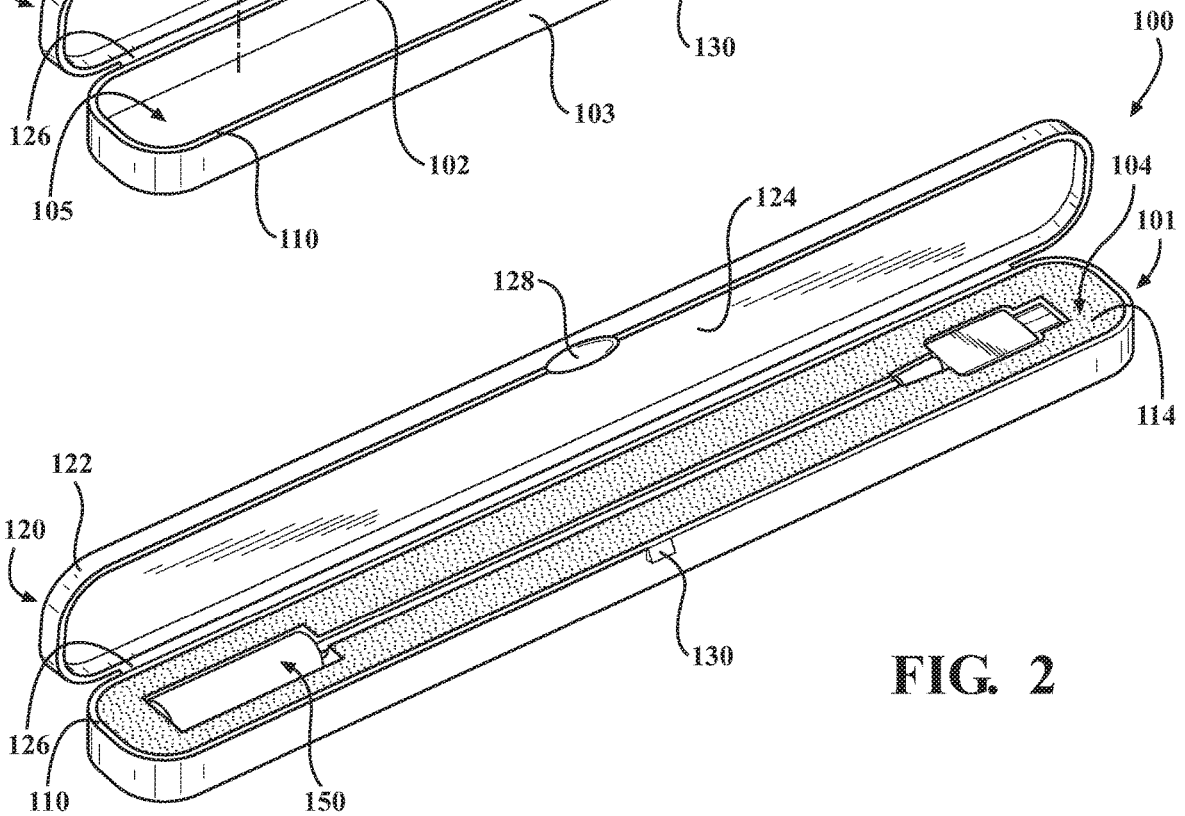
FIG. 2

AUDIO AND POWER ADAPTER RETENTION DEVICE

CROSS-REFERENCE TO RELATED PATENT APPLICATIONS

This application claims the benefit of priority under 35 U.S.C. § 119(e) to U.S. Provisional Patent Application No. 62/672,639, filed May 17, 2018, the entire contents of which are incorporated herein by reference.

BACKGROUND

The present disclosure relates generally to a retention device and cover utilized with audio, video, data, and power adapters for portable electronic devices.

Many portable electronic devices (e.g., mobile phones) use proprietary connectors for charging, headphone/earphone use, data syncing, or other functions, to save space, reduce weight and for improved or consistent aesthetics. Users wishing to interface such portable electronic devices with conventional audio, video, power, or data connectors need to use adapters (e.g., the Apple iPhone® Lightning to 3.5 mm headphone jack adapter (i.e., a "dongle")). Because such adapters are small and often are separately transported from their associated portable electronic devices, users frequently drop, misplace, and/or lose them. This may damage such adapters and inconvenience users who then waste time and/or money replacing or attempting to locate lost, misplaced, or damaged adapters. Accordingly, there exists a need for products and methods that protect and prevent loss or misplacement of such adapters, while conveniently storing and transporting them together with the devices with which they are used.

SUMMARY

At least one embodiment relates to a retention device for an adapter for a portable electronic device, comprising: (i) a shell comprising an interior surface defining an insert receiving region having an inner surface contour and an exterior surface; (ii) an insert within the insert receiving region, the insert comprising an upper surface having a cutout region shaped to receive an adapter for a portable electronic device, and a lower surface facing the insert receiving region and having a lower surface contour complementary to the inner surface contour; and (iii) a cover coupled to the shell and configured to extend adjacent to the upper surface of the insert when the insert is positioned within the insert receiving region.

In some embodiments, the insert is removable. In other embodiments, the insert is one of a plurality of inserts, each of the plurality of inserts having a respective cutout region with a shape configured to receive a corresponding adapter. In still other embodiments, the insert includes a resiliently deformable material.

In some embodiments, the cutout region is configured to retain the adapter within the insert by friction. In other embodiments, the cutout region further includes at least one indentation, wherein the cutout region deviates outwardly from the shape of its corresponding adapter and wherein the indentation is configured to allow a user to grasp the adapter using his or her finger and/or thumb.

In some embodiments, an adhesive is disposed on the exterior surface of the shell. In particular embodiments, a hook-and-loop fastener, hook-and-pile fastener, or touch fastener, is disposed on the exterior surface of the shell. In one particular embodiment, the hook-and-loop fastener includes a VELCRO strip disposed on the exterior surface of the shell. In other particular embodiments, the retention device includes a ring disposed on the exterior of the shell or cover, wherein the ring is configured to couple with a keychain ring, wallet chain, or lanyard.

In some embodiments of the retention device, the cover includes a latch member, and the shell includes a receiver member configured to reversibly couple to the latch member. In other embodiments, the cover further includes a convex exterior surface. In still other embodiments, the cover further includes a flat interior surface or a concave interior surface. In some embodiments, the cover is temporarily or permanently coupled to the shell along an edge of the shell, for example, by using at least one hinge mechanism.

Another embodiment relates to a retention device for an adapter for a portable electronic device, wherein the retention device is integrated into a case for a portable electronic device. In some embodiments, the portable electronic device is selected from the group consisting of a mobile phone, a tablet, a portable music player, or a laptop computer. In particular embodiments, the portable electronic device is a mobile phone.

This summary is illustrative only and is not intended to be in any way limiting.

BRIEF DESCRIPTION OF THE FIGURES

FIG. 1 is an exploded perspective view of a retention device according to one embodiment of the present disclosure.

FIG. 2 is a perspective view of a retention device according to one embodiment of the present disclosure, wherein the cover is open.

DETAILED DESCRIPTION

Figure 3:
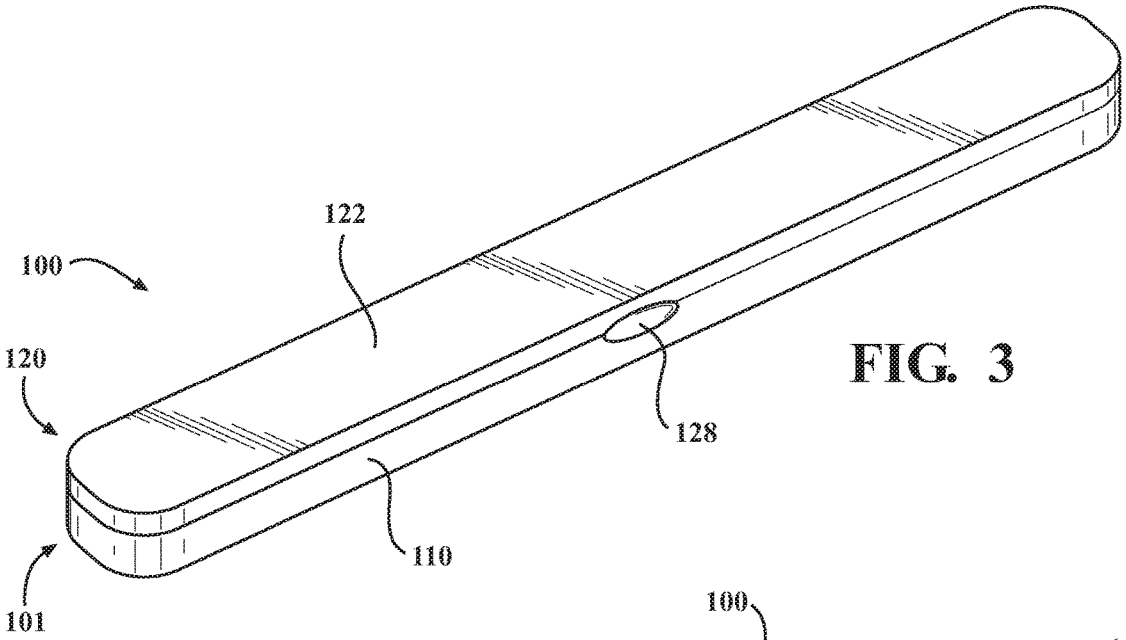
FIG. 3 is a perspective view of a retention device according to one embodiment of the present disclosure, wherein the cover is closed.

According to an exemplary embodiment, a retention device is provided for securing therein an adapter for use with portable electronic devices. One advantageous feature of such a retention device is that the retention device may act to secure the adapter in place in a manner that allows for the safe and secure storage of the adapter, which may reduce the occurrence of damage or loss of the adapter.

Referring now to FIG. 1, according to an exemplary embodiment, a retention device 100 includes a shell 101, which is configured to receive, retain, and protect an adapter 150 for a portable electronic device. The shell 101 includes an interior shell surface 102 and an exterior shell surface 103. The interior shell surface 102 further includes an inner surface contour and defines an insert receiving region 105 that is configured to receive and accommodate an insert 104.

Referring still to FIG. 1, the shell 101 includes a floor 106, having interior and exterior surfaces. According to one particular exemplary embodiment, the floor 106 is substantially planar, such that the retention device has a flat bottom, facilitating stable placement (i.e., without rolling) on flat surfaces (e.g., desktops, tabletops, etc.). In other embodiments, the shell 101 may include a continuous, convex exterior shell surface without corners, edges, or flat surfaces (e.g., in approximately the shape of a capsule). According to still other exemplary embodiments, the shell may have other configurations.

Referring still to FIG. 1, the shell 101 includes at least one perimeter wall 110 having interior and exterior surfaces. According to an embodiment, the shell 101 includes only one perimeter wall 110, which may include rounded corners. In other embodiments, the contour of the perimeter wall may include no corners (i.e., defining the two-dimensional contour of an oval, capsule, or other similar shape) and may adjoin the floor 106 at a substantially right angle. In another embodiment (not shown), the shell may include a substantially planar floor 106 and four perimeter walls 110, with each wall adjoining adjacent walls and the floor 106 at substantially right angles to define a substantially rectangular prismatic insert receiving region 105 with a substantially rectangular interior contour.

The shell 101 may be formed from any material suitable to provide impact resistance (e.g., hard plastic, metal, etc.) and protect an adapter contained therein. According to an exemplary embodiment, the shell 101 is manufactured from a lightweight, durable plastic material (e.g., acrylonitrile butadiene styrene (ABS), polypropylene, high-density polyethylene (HDPE), polycarbonate (PC), etc.) or from a lightweight metal (e.g., aluminum). The perimeter walls 110 and floor 106 may be formed from either the same or different materials. According to an exemplary embodiment, the perimeter walls 110 and the floor 106 are formed from the same material to facilitate easy manufacturing and achieve a uniform appearance.

Referring now to FIGS. 1 and 2, the retention device 100 includes an insert 104, which is positioned within the insert receiving region 105 and is configured to retain and protect an adapter 150. According to an exemplary embodiment, the insert 104 includes an upper surface 114 having a cutout region 116 shaped to receive an adapter 150 for a portable electronic device. Additionally, the cutout region 116 may have slightly smaller dimensions than the outer contour dimensions of the adapter 150, such that the insert 104 material must slightly deform to accommodate and receive the adapter 150.

Referring still to FIGS. 1 and 2, the insert 104 includes a bottom surface 115 shaped to complement the inner contour of the insert receiving region 105. For example, the insert 104 may have substantially the same, slightly larger, or slightly smaller dimensions than the inner contour of the insert receiving region 105, such that the insert 104 may snugly fit within the insert receiving region 105, to better withstand jostling and everyday handling while preventing the insert 104 from falling out of the shell 101. Alternatively, or in addition to retention by friction, the insert 104 may be adhered to the interior surface of the shell (i.e., to one or more interior surfaces of at least one perimeter wall 110) using an adhesive or may be retained within the shell 101 by tabs or similar retention means.

Figure 4:
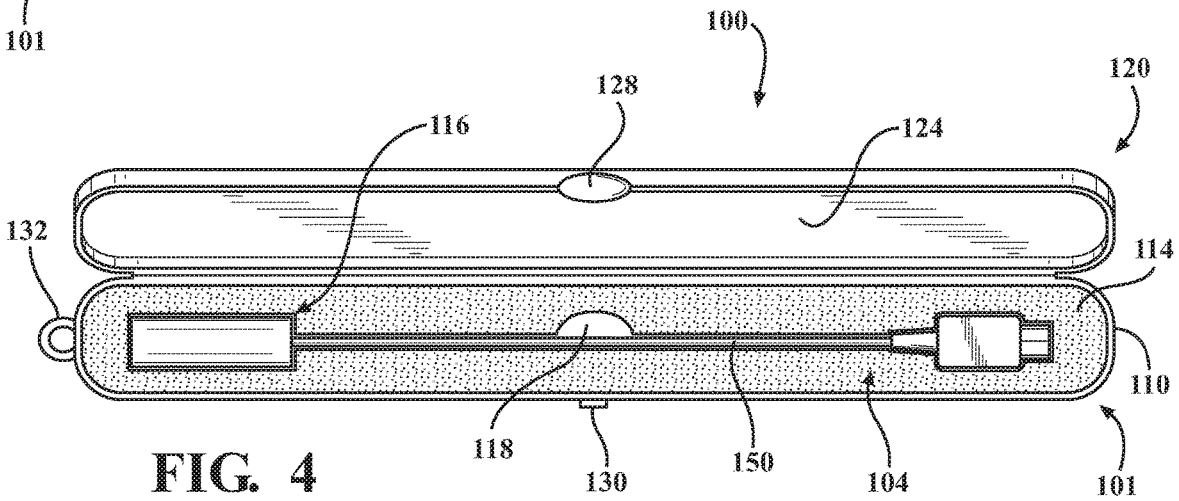
FIG. 4 is a top-down view of a retention device according to one embodiment of the disclosure.

Referring now to FIGS. 2 and 4, the insert 104 is manufactured from a lightweight, resilient, deformable material (e.g., rubber, silicone, memory foam, etc.), which, after deforming to accommodate the adapter 150, substantially springs back to its original shape to compress the adapter 150, thereby holding the adapter in place within the cutout region 116 by friction. In this configuration, the adapter 150 cannot be easily dislodged from the insert 104 by jostling or light impact (e.g., that occurring during transport) but may be removed when the user applies a small amount of force to lift the adapter 150 from the insert 104.

Referring still to FIG. 4, the cutout region 116 further includes one or more indentations 118, where the contour of the cutout region 116 is configured to depart outwardly from the outer contour of the adapter 150. In this manner, the indentation 118 may provide a space between the outer contour of the cutout region 116 and the adapter 150 into which the user may insert his or her thumb and/or finger, thereby permitting the user to grasp the adapter 150 and lift the adapter out of the cutout region 116 without damaging the adapter or the insert 104. One or more indentations 118 may be disposed at any location along the contour of the cutout region 116.

Referring back to FIG. 1, the cutout region 116 is provided as an aperture (i.e., through-hole) extending through the entire thickness of the insert 104. In other embodiments, however, the cutout region 116 may include an opening in the top insert surface 114, having a depth of less than the insert thickness, such that the cutout region 116 does not extend completely through the insert 104. This may provide additional cushion to the bottom of the adapter during transport and further protect the adapter from damage if the retention device is jostled or dropped.

In some embodiments, the insert 104 may be approximately equal in height to the at least one perimeter wall 110, such that the insert 104 has substantially the same height, outer dimensions, and contour as the insert receiving region 105. In other embodiments, the insert 104 may have a thickness that is less than the height of the perimeter walls 110. In still other embodiments, the insert 104 may have a thickness equal to the thickness of the adapter 150 (e.g., between 0.5 and 10 mm, preferably between 4 and 6 mm).

Figure 5:
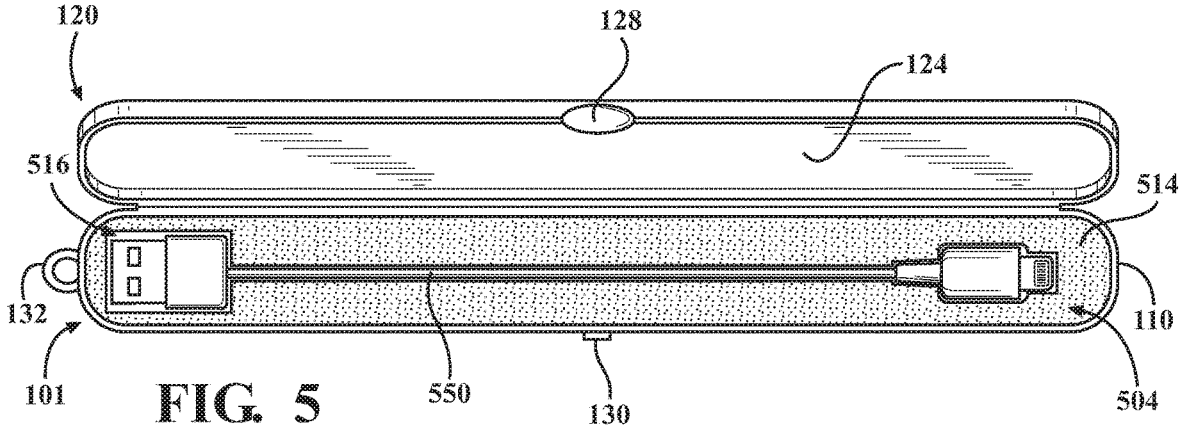
FIG. 5 is a top-down view of a retention device according to another embodiment of the disclosure.

Referring now to FIGS. 4 and 5, according to another embodiment, the insert 104 is removable and interchangeable with other inserts (e.g., 504) configured to retain different types of adapters (e.g., 550). In such embodiments, inserts (e.g., 104, 504) have substantially the same outer contours and dimensions as one another, such that both fit snugly into the insert receiving region 105. Additionally, in such embodiments, each of the interchangeable inserts (e.g., 104, 504) includes a respective cutout region (e.g., 116, 516) with a shape configured to receive a corresponding adapter (e.g., 150, 550). In this manner, a single retention device may be configured to retain several different types of adapters.

Referring again to FIGS. 1-3, the retention device 100 further includes a cover 120 configured to extend adjacent to the upper surface 114 of the insert 104 when the insert is positioned within the insert receiving region 105. The user may couple the cover 120 to the shell 101 to hold the cover 120 and shell 101 in abutment (e.g., such as in a closed position, shown in FIG. 3), to protect and retain an adapter 150 retained within the insert 104. To facilitate holding the cover 120 in a closed position, in some embodiments, the cover 120 further includes one or more fastener mechanisms (e.g., a latch, snap-on or snap-fit mechanism, ball detent, etc.) for holding the cover 120 and shell 101 in abutment. For example, in an embodiment, the cover 120 includes a latch 128 that reversibly couples to a receiver 130 on the shell 101. In a particular embodiment, the receiver 130 is disposed on a perimeter wall 110 (e.g., on the exterior shell surface 103).

Referring still to FIGS. 1-3, the cover 120 further includes an exterior cover surface 122 configured to facilitate ergonomic handling by the user and decrease the likelihood of dropping the retention device 100 when the user handles and/or transports it. In one embodiment, the exterior cover surface 122 may be convex. The cover 120 further includes a cover interior surface 124. Cover interior surface 124 may be concave, such that it follows the contour of a convex exterior cover surface 122. In still other embodiments, the interior cover surface 124 may be flat, such that the interior cover surface 124 maintains contact with or close proximity to (e.g., within approximately 1-2 mm) the upper surface 114 of the insert 104 (and optionally, the adapter 150) when the cover 120 is closed (e.g., FIG. 3). In this configuration, the cover interior surface 124 may prevent movement of the adapter 150 retained within the cutout region 116, further protecting the adapter from damage.

Referring still to FIGS. 1-3, in some embodiments, the cover 120 may be a separate component configured to completely attach to and detach from the shell 101. In other exemplary embodiments, however, the cover 120 is permanently or temporarily coupled to the shell 101 by one or more hinge mechanisms 126. The one or more hinge mechanisms 126 may include any suitable means of coupling the cover 120 to the shell 101 while permitting the cover 120 to be moved into a closed position (FIG. 3) or open position (FIG. 2). For example, in some embodiments, the shell 101 and cover 120 may be formed from the same piece of material, such that the hinge mechanism 126 includes one or more thin, flexible strips of the material from which the cover 114 and shell 101 are formed, permitting the user to easily open and close the retention device 100 without fully detaching the cover 120. In other embodiments, the cover 120 and the shell 101 may be formed as discrete components but may be coupled using one or more separate hinge mechanisms 126 (e.g., a butt hinge, butterfly hinge, spring hinge, etc.), each of which is fastened to the cover 120 and the shell 101 (e.g., to an exterior surface of the cover 120 and an exterior surface of a perimeter wall 110).

In some embodiments, the retention device 100 may further include one or more structures for attaching the retention device to a surface to prevent the retention device and the adapter contained therein from being misplaced, dropped, or damaged. For example, an adhesive (e.g., a double-sided adhesive) or other attachment mechanism may be disposed on the shell exterior surface 103 (e.g., on the bottom of the shell). In one embodiment, a hook-and-loop fastener, hook-and-pile fastener, or touch fastener (e.g., a VELCRO strip) may be disposed on the exterior floor surface, to match a complementary strip disposed on a surface (e.g., mobile phone case, tablet case, desktop, tabletop, etc.) where the user desires to place the retention device 100. In another embodiment, a heavy duty hook-and-loop fastener (e.g., VELCRO) strip, along with its complementary strip, may be permanently adhered to the exterior shell surface 103 (e.g., on the bottom of the shell), such that the adhesive side of the complementary strip faces outward for temporarily adhering the retention device 100 to a surface (e.g., a desktop). In this configuration, the complementary hook-and-pile fastener strips may strongly adhere to each other and to the shell 101, such that removing the outward-facing adhesive from a stationary surface (e.g., a desktop) does not delaminate the strips from one another or from the shell 101.

In some embodiments, the retention device 100 may further include one or more structures for coupling the retention device 100 to a keychain ring, lanyard, wallet chain, or similar vehicle. For example, according to the embodiment shown in FIG. 4, the retention device 100 includes a ring 132 coupled to and disposed on an exterior surface of the cover 120 or shell 101. The ring 132 may be configured to couple to a keychain ring, wallet chain, lanyard, or similar vehicle, to permit transportation of the retention device and further prevent misplacement, loss, theft, or damage of an adapter contained therein.

Figure 6:
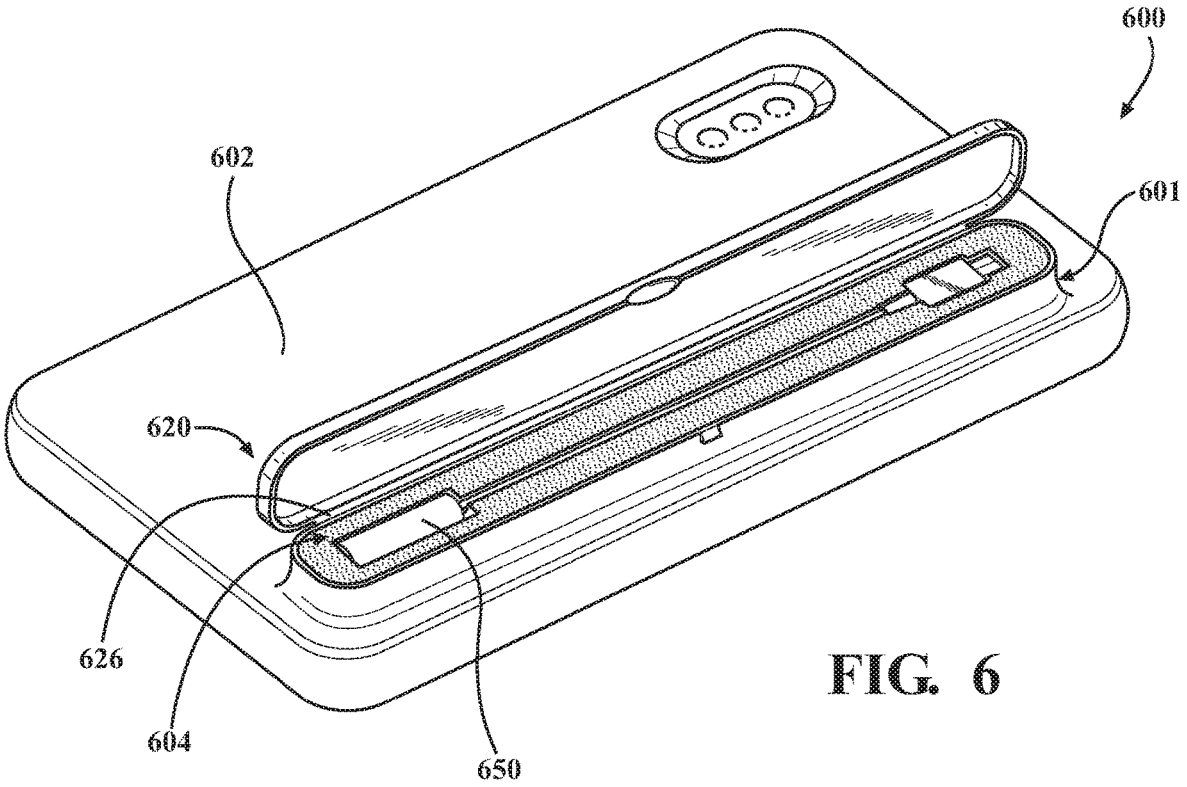
FIG. 6 shows a perspective view of an integrated retention device according to another embodiment of the present disclosure.

Referring now to FIG. 6, in some embodiments, a retention device according to the present disclosure may be an integrated retention device 600, which may be integrated into or embedded within a protective case 602 for a portable electronic device (e.g., a laptop, tablet, portable music player, or mobile phone, etc.). For example, in a particular embodiment, an integrated retention device 600 includes a shell 601 that is integrated into a mobile phone protective case 602 (e.g., on the back side of a mobile phone case) Similar to the embodiments described above and shown in FIGS. 1-5, the interior surface of the shell 601 defines an insert receiving region configured to retain and accommodate an insert 604. Insert 604 may be formed from the same types of materials (e.g., resiliently deformable polymers or foams) and function to retain and protect an adapter 650, in the same manner (e.g., retaining the adapter by friction or using tabs, etc.), as disclosed above for other embodiments of the retention device.

According to an exemplary embodiment, an integrated retention device (e.g., retention device 600) further includes a cover such as the cover 620 shown in FIG. 6. In some embodiments, the cover exterior surface 622 may be configured to be substantially co-planar with the exterior of the protective case 602, when the integrated retention device is closed. In other embodiments, like that shown in FIG. 6, at least a portion of the integrated retention device 600 protrudes from the protective case 602. The cover 620 may be coupled to the mobile phone case 602 or to the shell 601 using one or more hinge mechanisms 626. Alternatively, the cover 620 may be configured to slide on and off the shell 601.

The term "adapter," as used herein, refers to any device that converts attributes of one portable electronic device or system to those of an incompatible device or system. For example, the Apple iPhone® Lightning to 3.5 mm audio jack adapter allows users to attach a conventional audio jack, found in most common headphones, to devices that output an audio signal using Apple's Lightning port. (See, e.g., *iPhone Accessories*, Apple (2019), https://www.apple.com/shop/product/MMX62AM/A/lightning-to-35-mm-headphone-jack-adapter?fnode=97.) Those having ordinary skill in the art will understand that the "adapter" of the present disclosure is intended to encompass all such adapters (e.g., audio, video, USB, micro-USB, HDMI, charging, etc.), regardless of the type of portable electronic device (e.g., mobile phone, tablet, laptop, portable music player, etc.) and device brand/type (e.g., Android phone, iPhone®, etc.).

The term "resiliently deformable material," as used herein, refers to any material that may be deformed from its original shape and/or size by application of compressive (pushing), tensile (pulling), torsional (twisting) or bending forces (e.g., small forces applied by the human hand) but substantially returns to (i.e., springs back) to its original shape and/or size once the deforming force is removed. Non-limiting examples of "resiliently deformable materials" include foams (e.g., memory foams, foamed rubbers), silicones, elastomers, and similar materials.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the retention device as shown in the various exemplary embodiments is illustrative only. Additionally, any element disclosed in one embodiment may be incorporated or utilized with any other embodiment disclosed herein. For example, the indentation 118 of the exemplary embodiment shown at least in FIG. 4 and described in the corresponding discussion thereof may be incorporated in integrated retention device 600, the exemplary embodiment shown in FIG. 6 and described in the corresponding discussion thereof. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A retention device for an adapter for a portable electronic device, comprising:

a shell comprising an interior surface defining an insert receiving region having an inner surface contour and an exterior surface;

an insert within the insert receiving region, the insert being removable from the insert receiving region and the insert being formed of a resiliently deformable material, the insert comprising an upper surface having a cutout region shaped to receive an adapter for inserting into a portable electronic device, and a lower surface facing the insert receiving region and having a lower surface contour complementary to the inner surface contour, wherein the cutout region has a shape which is complementary to a profile of the adapter such that the adapter is contained within the cutout region when received therein;

a cover coupled to the shell using at least one hinge mechanism along a length-side of the shell, the cover configured to extend adjacent to the upper surface of the insert when the insert is positioned within the insert receiving region; and wherein the retention device is integrated into a case for a portable electronic device.

2. The retention device of claim 1, wherein the insert is one of a plurality of inserts, each of the plurality of inserts having a respective cutout region with a shape configured to receive a corresponding adapter.

3. The retention device of claim 1, wherein the cutout is configured to retain the adapter within the insert by friction.

4. The retention device of claim 1, wherein the cutout region further comprises at least one indentation, wherein the cutout region deviates outwardly from the shape of its corresponding adapter and wherein the indentation is configured to allow a user to grasp the adapter using his or her finger and/or thumb.

5. The retention device of claim 1, wherein the cover comprises a latch member, and wherein the shell comprises a receiver member configured to reversibly couple to the latch member.

6. The retention device of claim 1, wherein the cover further comprises a convex exterior surface.

7. The retention device of claim 1, wherein the cover further comprises a flat interior surface.

8. The retention device of claim 1, wherein the cover further comprises a concave interior surface.

9. The retention device of claim 1, wherein the cover is permanently coupled to the shell along an edge of the shell.

10. The retention device of claim 1, wherein the portable electronic device is selected from the group consisting of a mobile phone, a tablet, a portable music player, or a laptop computer.

11. The retention device of claim 10, wherein the portable electronic device is a mobile phone.

* * * * *